US005826288A

United States Patent [19]

Ecer

[11] Patent Number: 5,826,288

[45] Date of Patent: Oct. 27, 1998

[54] HIGHLY PREMEABLE INFANT MATTRESS AND PAD

[76] Inventor: Gunes M. Ecer, P. O. Box 4025, Thousand Oaks, Calif. 91359

[21] Appl. No.: 743,042

[22] Filed: Nov. 4, 1996

[51] Int. Cl.[6] ..... A47C 27/12; A47G 9/00

[52] U.S. Cl. ..... 5/724; 5/655; 5/652.1

[58] Field of Search ..... 5/638, 655, 724, 5/725, 726, 652.1, 652.2

[56] References Cited

U.S. PATENT DOCUMENTS

| | | | |
|---|---|---|---|
| 3,216,028 | 11/1965 | Lawson | 5/640 |
| 3,616,470 | 11/1971 | Young et al. | 5/652.1 |
| 3,859,678 | 1/1975 | Davis . | |
| 5,050,256 | 9/1991 | Woodcock | 5/482 |
| 5,093,946 | 3/1992 | Difloe | 5/652.1 |
| 5,109,560 | 5/1992 | Uetake | 5/713 |
| 5,305,483 | 4/1994 | Watkins | 5/698 |
| 5,317,767 | 6/1994 | Hargest et al. | 5/638 |

FOREIGN PATENT DOCUMENTS

| | | |
|---|---|---|
| 1046050 | 3/1965 | United Kingdom . |

*Primary Examiner*—Alexander Grosz
*Attorney, Agent, or Firm*—William W. Haefliger

[57] ABSTRACT

An infant supporting mattress or pad, comprising in combination a liquid permeable fibrous pad core, and a high permeability cover extending about the pad core, and in contact therewith, to wick liquid passing through the cover away from the cover, the cover including strands of material defining a cover porous texture, the texture characterized as freely passing aqueous liquid of a viscosity between 0.03 and 0.09 poise through open work, and into the core.

11 Claims, 2 Drawing Sheets

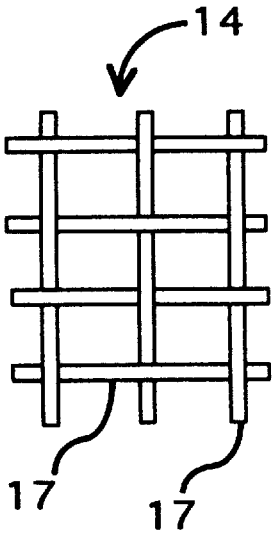
FIG. 3
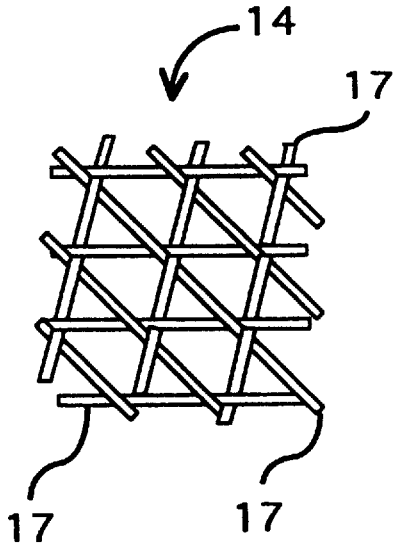
FIG. 4
FIG. 5
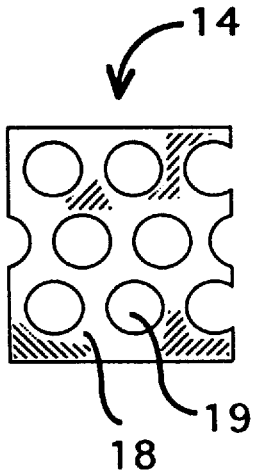

HIGHLY PREMEABLE INFANT MATTRESS AND PAD

BACKGROUND OF THE INVENTION

This invention relates to bedding systems. More specifically, to fluid permeable infant mattresses and pads.

The subject invention offers highly permeable infant bedding systems such as crib mattresses and pads, and cradle and bassinet pads with the objective of lowering incidents of sudden infant death syndrome due to suffocation, and occurrence of contact dermatitis in infants.

Sudden infant death syndrome, commonly known as SIDS, which affects 1.6 to 2.3 of every 1,000 infants born in the United States, is the leading cause of death for babies between 1 month and 1 year. Recently, mounting evidence has indicated that babies who sleep face down (prone position) are at 50% greater risk when compared to babies who sleep on their backs or sides (supine position).

While there is no clear explanation of why the prone position may contribute to the risk of SIDS, some researchers indicate that it may predispose a small number of infants to suffocate through blockage of their air passages, and through breathing of their own exhaled carbon dioxide.

The American Academy of Pediatrics (AAP) is now recommending for healthy babies born at term to sleep on their side or back, not on their stomachs, suggesting that the prone position could increase the risk of sudden infant death syndrome. Still, the AAP recommends that premature babies with breathing problems, infants with frequent vomiting or spitting, and infants with anomalies that predispose them to obstruction of their breathing passages may sleep in prone position. Even with healthy babies, following AAP's recommendation does not necessarily eliminate any possibility of suffocation. Infants sleeping on their side or back have been known to often roll face down as soon as they have the strength to do so.

Los Angeles Times (Jul. 1, 1991, page B3) referring to a study published in the New England Journal of Medicine reported that beanbag cushions can suffocate an infant who lies face down in them, and some deaths once attributed to the mysterious SIDS may have been caused by the cushions. An article in The New York Times (Apr. 8, 1992, page C15), referring to studies by several scientists, suggested that ordinary bedding materials, not just the beanbag cushions already recalled by the government, may have suffocated babies whose deaths were reported as crib death. It is believed that some unexplained infant deaths may be explained by exhaled carbon dioxide being trapped around the baby's face by bedding such as pillows, comforters and foam beds.

It is clear that at least some, perhaps up to 50%, of the SIDS deaths may be preventable if bedding construction and materials were firm and would allow the free breathing of air when and infant's face is resting against it even in the presence of regurgitated milk or formula. There are no such infant bedding available in the commercial marketplace. All available mattresses and mattress pads rely on traditional materials with low or no permeability to air and fluids.

Much of the prior art on bed mattresses has dealt with the support function and durability of mattresses. As a consequence, most commercial mattresses and cushions are designed for long service life and for an even support of a body of uneven weight distribution. Because infant mattresses and pads available today are constructed using metal springs or synthetic resin moldings, they are encased in covers of low or non permeable materials to facilitate cleaning of any spills or baby excrement by wiping with a damp cloth. Even adult bedding containing permeable polyester fiber densified batting fillers and cores are covered with impermeable covers. These mattresses are not washed but wiped clean, a practice which may result in an unsanitary and dangerous situation for babies. Low or non-permeable mattresses may allow formation of temporary pools of regurgitated formula which can clog infant's air passages perhaps leading to SIDS, or it can often cause contact dermatitis which results from the skin breakdown due to contact with acid or other chemicals in the regurgitated formula or milk.

Uetake U.S. Pat. No. 5,109,560 provides a ventilated air mattress constructed of pneumatic envelopes. Ventilation is achieved through conduits having plurality of exhaust ports connected to a source of compressed air. Uetake's mattress has highly complex construction, and is very expensive which precludes its use as an infant mattress.

Woodcock U.S. Pat. No. 5,050,256 offers an allergen proof bedding system with cover permeable to water vapor but impermeable to mite. The permeable mite barrier material in the Woodcock bedding totally encloses and prevents passage of fluid between inside and outside mattress as well as preventing mite migration. Such a bedding system could be dangerous for babies.

SUMMARY OF THE INVENTION

This invention concerns itself primarily with a mattress or pad that allows infant formula or milk, spilled or regurgitated, to be instantaneously removed away from a cover surface into the depths of the core of the mattress or pad, thus permitting free air flow for breathing by the baby whose face may be resting on the mattress surface, and reducing the possibility of prolonged contact between the baby and its regurgitated milk or formula. This is accomplished by the use of a fiber filling, preferably polyester fiber filling, densified to a desired density serving as the resilient interior (core) of a mattress or pad encased in a highly porous covering selected for its high permeability to infant formula. The present invention also assures a high degree of firmness for a safer mattress, and provides highly porous, self ventilating mattress and padding materials for a cooler sleep, for ease of handling, washing, and good hygiene.

Basically, the infant supporting mattress or pad, comprises in combination:

a) a liquid permeable fibrous pad core, b) and a high permeability cover extending about the pad core, and in contact therewith, the core wicking liquid passing through the cover away from the cover, c) the cover including strands of material defining a cover porous texture, the texture characterized as freely passing aqueous liquid of a viscosity between 0.03 and 0.09 poise through open work, and into the core.

As will appear, the cover typically comprises two halves encasing the core, and stitching interconnecting the two halves.

It is another object of the present invention to provide an infant mattress and an infant pad, to be used in a crib, a bassinet, or a cradle, highly permeable to infant formula and milk with the intention of reducing the incidence of sudden infant death syndrome due to suffocation, and infant skin rash due to contact dermatitis. Cover texture, and cover and pad core permeability are as defined herein to enable the rapid removal of liquid applied to the cover through to cover and into the core as by wicking action.

It is another object of the present invention to provide a firm infant mattress, and a firm infant pad for improved infant safety.

It is yet another object of the present invention to provide a washable infant mattress, and an infant pad for an improved hygienic bedding environment for a baby.

A further object is to provide a pad cover and core that do not rely upon forced air to dissipate infant expelled liquid through the cover and into the core.

Thus, there is disclosed herein a highly permeable and washable infant mattress and an infant pad that is safer for infants. It will be understood that the foregoing general description and the following detailed description as well are exemplary and explanatory of the invention but are not restrictive thereof.

These and other objects and advantages of the invention, as well as the details of an illustrative embodiment, will be more fully understood from the following specification and drawings, in which:

DRAWING DESCRIPTION

FIG. 3 is an enlarged view of one example of a highly permeable cover shown in FIG. 1;

FIG. 4 is an enlarged view of another example of a highly permeable cover shown in FIG. 1; and FIG. 5 is an enlarged view of yet another example of a highly permeable cover shown in FIG. 1.

DETAILED DESCRIPTION

The term infant mattress, in the following description of the present invention, refers to a resilient structure of at least 2 inches in thickness, while an infant pad is taken to mean the same type of bedding structure but less than 2 inches in thickness. Widths and lengths of pads and mattresses for infants can vary depending upon the end use. Infant cradles, baskets, bassinets, cribs, and portable cribs are among the intended end uses for the infant mattresses and pads constructed according to the present invention. For simplicity, a detailed description of the invention will be given only as it relates to an infant mattress since the only difference between the construction of an infant mattress and an infant pad is in the thickness as defined above.

Figure 1:
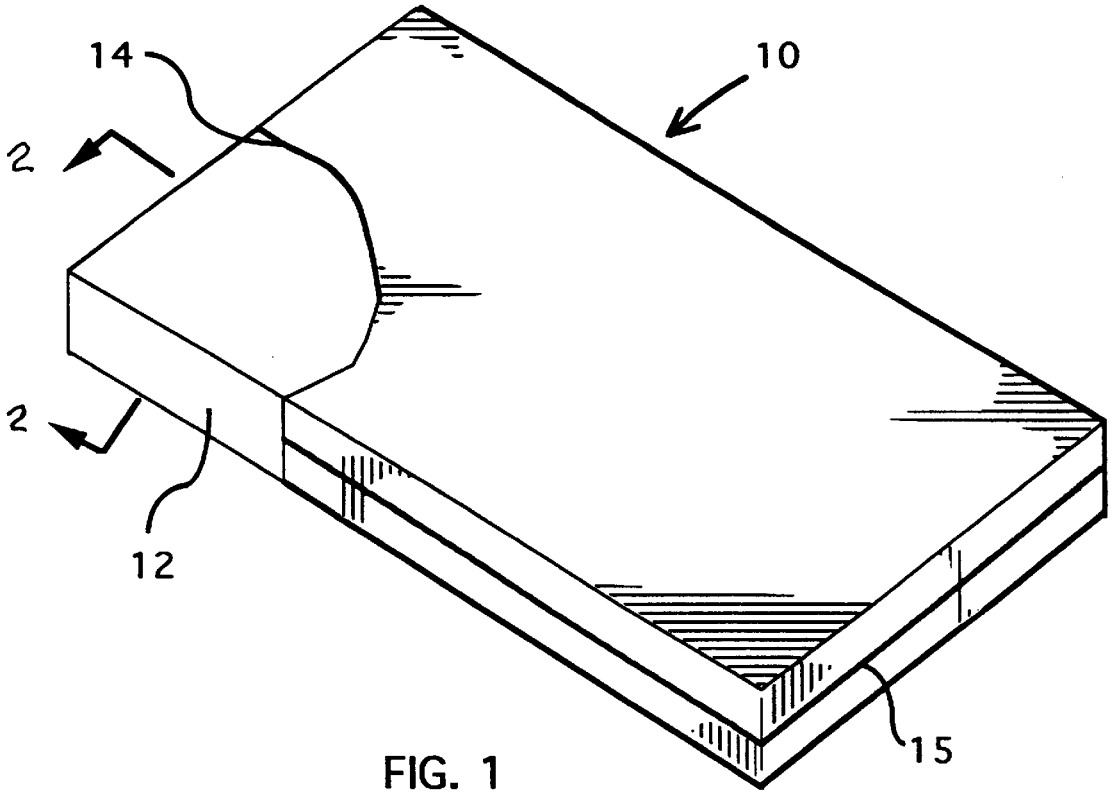
FIG. 1 is a perspective view showing an infant mattress for a crib with a partly broken cover encasing a densified fiber mass forming the resilient core of the mattress according to one embodiment of the present invention.
Figure 2:
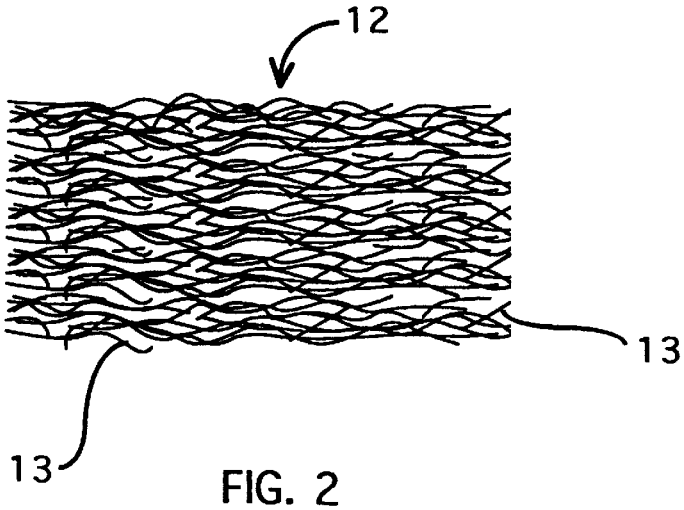
FIG. 2 is an enlarged sectional view of densified fiber core of a mattress taken along on plane A—A shown in FIG. 1; enlarged view of one example of a highly permeable cover shown in FIG. 1.

Referring now to the drawings, there is shown in perspective form in FIG. 1 one example of an infant mattress 10 constructed according to this invention comprising a resilient core of densified fiber mass 12 encased in a high permeability cover 14 sewn together along line 15. Enlarged sectional view of densified fiber mass 12 shown in FIG. 2 is illustrated by way of example only and not by way of limitation. Fibers 13 are randomly packed together to create a resilient and highly porous fiber mass 12 that has been densified to a desired density to provide a desired firmness and permeability to infant formula. Fiber 13 is selected among materials that are resistant to moisture and mildew, resistant to common cleaning materials, are hypoallergenic and are odor free. While these conditions can be met by fibers of some metals, some ceramics, carbon, and others, synthetic fibers similar to those used in textiles are preferred because of their high flexibility, low cost and ease of densification. Polymeric fibers such as nylon, polyester, and poly propylene are among the preferred fibers for the construction of densified fiber core 12 since these types of fibers meet all the requirements listed above. A densified polyester fiber batting also meets such requirements.

To be safe and comfortable, an infant mattress should not flex excessively under the weight of an infant, and should resiliently spring back to its original configuration once the load is lifted. If the heady of a baby resting on an infant mattress is simulated by a 1,000 gram weight applied over a 40 mm×40 mm square area in the center of an infant mattress, the depression created in the mattress by the weight should not be more than 40 mm deep. Once the 1,000 gram load is lifted the mattress should display resilience by assuming its original shape, and the depression should completely disappear. For depressions more than 40 mm deep, it becomes increasingly difficult for the baby to move and change her position. Inability to move her head and body can be discomforting for the baby. The 1,000 gram weight test just described can adequately define the firmness of an infant mattress while being a good indicator of its resilience. In the present invention, the firmness of mattress 10 is determined to a large extent by the firmness of fiber core 12 as cover 14 does not significantly add to firmness.

The depth of depression in fiber core 12 measured in the 1,000 gram weight test depends on a number of factors including fiber type and composition, fiber diameter, fiber mix, and fiber mass densification process. All other factors remaining constant, the densification process used to created fiber core 12 would determine fiber core firmness. Densification of fiber core 12 may be accomplished by mechanical, chemical, solvent, or thermal means. The degree of bonding between individual fibers is a primary factor in determining fiber mass rigidity or firmness, porosity, and density. Often, the higher the density, the higher is the firmness, and the lower is the amount of porosity. Since lower porosity leads to lower permeability to liquids, fiber core 12 is selected to provide the best compromise between firmness and permeability to infant formula.

Permeability of densified fiber core 12 to infant formula to a large extent depends on the surface tensional force per unit volume of fibers and viscosity of the infant formula. The higher the total surface tensional force between fibers 13 and infant formula per unit volume of densified fiber core 12, the lower will be the permeability to formula. Thus, fiber 13 material type and diameter, and density of fiber core 12 together partially determine permeability to infant formula. Viscosity of the infant formula significantly influences permeability of fiber core 12 to formula. Viscosities of most infant formulas, whether they are milk based or vegetable based, would fall between 0.03 and 0.09 poise depending on the degree of their dilution with water. Other factors that may affect permeability include temperature, fiber surface contamination, and non-uniformity of fiber distribution in the densified fiber core 12.

Permeability of fiber core 12 to infant formula may be determined by measuring the absorptivity of fiber core 12 since it is easier to measure absorptivity than to measure permeability. Absorptivity being inversely proportional to permeability, a maximum limit of acceptance put on absorptivity means a minimum limit of acceptance in terms of permeability. Absorptivity can be empirically measured by the amount of spread of a unit volume of as ready to eat baby formula at 27° C. +/−1° C. introduced on the surface of fiber core 12, and may be expressed in $mm^2$ of formula spread from a central point where the formula is introduced onto the surface fiber core 12 with an eyedropper while the eyedropper is held gently in contact with the surface of the fiber core being tested. A high absorptivity measure in this way indicates that any vomited baby formula would remain absorbed in the fiber mass, and would be in contact with baby's face resting on the mattress. On the other hand, a low absorption (or high permeability) would mean any vomited formula would flow into and through the fiber mass causing no ill effects on the baby.

According to the present invention, fiber core 12 is selected on the basis of the above described formula spread test where a 2.5 $cm^3$ of ready to feed liquid infant formula having a viscosity of about 0.06 poise is applied onto fiber core 12, and if the formula spreads to a surface area more than 300 $mm^2$, that fiber core is rejected. This represents approximately the area of a circle whose diameter is 20 mm which approximates the distance between a newborn baby's nose and mouth.

Cover sheet 14, as seen in FIG. 1, must also have an open structure to be highly permeable to infant formula. Knitted, braided, woven, or non-woven cloth textiles made of cotton or synthetic yarns, filaments, or fibers or mixtures thereof are preferred for cover 14 provided they display more than the minimum permeability (or less than the maximum absorptivity) as determined by the above described formula spread test. Cover 14 is a woven fabric constructed by yarns, fibers, or filaments interlaced to form various patterns such as plain weave of yarns 17 as in FIG. 3, triaxial weave of one or more types of yarns 17 as in FIG. 4, harness satin, or leno weaves (not shown). Cover 14 can alternatively be a knitted fabric typically constructed by interlocking series of loops of one or more yarns, or a braided fabric formed by interlacing yarns diagonally to the production of the material, or a nonwoven fabric which is an assembly of textile fiber held together by mechanical interlocking in a random web or mat bonded by fusion or a glue. A plastic sheet 18 with punched holes 19, as in FIG. 5, may also be used as cover 14. The process of encasing fiber core 12 with cover 14 involves sewing of the two halves of cover 14 material along line 15 seen in FIG. 1.

An infant mattress exhibiting desired high permeability to infant formula, and having sufficient firmness was constructed by selecting a suitable fiber core and a high permeability cover sheet in the manner described below.

Fiber core 12 was selected from among a number of polyester fiber masses densified to several densities. Results of the 1,000 gram weight tests and the formula spread tests conducted on these fiber masses (candidate fiber cores) are given in Table 1.

TABLE 1

| Fiber Mass | Density ($g/cm^3$) | Depth of depression[2] (mm) | Formula[3] Spread ($mm^2$) |
|---|---|---|---|
| 1. 100% Celbond[1] polyester fiber - 3.0 cm layer | 0.0089 | 28 | 8 |
| 2. 100% regular polyester fiber densified by stitch bonding 0.5 cm thick web | 0.1137 | 1 | 631 |
| 3. 15% Celbond polyester-85% regular polyester heat densified-3.8 cm thick | 0.0188 | 16 | 22 |
| 4. 10% Celbond Polyester 90% regular polyester heat densified-6 cm thick | 0.0166 | 21 | 16 |

TABLE 1-continued

| Fiber Mass | Density ($g/cm^3$) | Depth of depression[2] (mm) | Formula[3] Spread ($mm^2$) |
|---|---|---|---|
| 5. 20% Celbond polyester 80% regular polyester heat densified-13 cm thick | 0.0282 | 5 | 31 |
| 6. 100% regular polyester fiber densified by stitch bonding 0.5 cm thick web | 0.0704 | 2 | 287 |
| 7. 100% Celbond polyester fiber-5.0 cm layer | 0.0074 | 58 | 5 |

(1) Celbond is a registered trade mark of Hoechst Celanese Corporation, Charlotte, NC.
(2) Depth of depression under a 1000 g load applied over a 40 mm × 40 mm square area of fiber mass.
(3) The formula used in these tests was the ready to feed SMA iron fortified infant formula by Wyeth Laboratories, Inc., Philadelphia, PA. Each test involved measuring the surface spread of 2.5 ml of formula applied on the surface with an eyedropper whose tip was in gentle contact with the material being tested.

Based on the results summarized in Table 1, No. 7 was eliminated as a possible fiber core 12 material because of its lack of firmness, and No.'s 2 and 6 were eliminated on the basis of the formula spread test results which showed that these materials were not sufficiently permeable to infant formula, i.e., formula spread to over 300 $mm^2$ of surface area. Among the remaining four acceptable fiber masses, namely No.'s 1, 3, 4 and 5, No. 5 was selected for its higher firmness as determined by the 1,000 gram weight test. All seven test materials exhibited the required resilience by returning back to their original shape after lifting the 1,000 gram weight after the 1,000 gram weight tests.

The types of fiber masses listed in Table 1 are readily available from Reliance Fiber Corporation, Gardena, Calif. These materials are used mostly in upholstery, and a small amount is used in bedding. One type of mattress used in prisons contains densified polyester fibers, called densified batting, encased in ticking which is not permeable to liquids. Sometimes in regular mattresses springs are covered with an inch thick of densified polyester batting and another layer of polyurethane foam before being encased in an impermeable ticking.

Next, a series of cotton, polyester, and nylon cloths were given the formula spread test to assess their suitability as cover 14. Tests were conducted with and without a fiber mass backing. In the former case, the cloth being tested would be in intimate contact with the fiber mass identified as No. 3 in Table 1. The same ready to eat infant formula described in Table 1 was used. The tests were carried out in the manner described in the note No. 3 of Table 1 above. In addition to measuring the spread of formula on the surface, the tendency for the formula to form a pool on the surface before being absorbed by the cloth and/or fiber mass material was recorded. Formation of a pool of formula that lasts at least 3 seconds before it is absorbed into the mattress is not desirable because of the danger of clogging the air passages of the baby who may inhale it. Results of these tests, along with the number of holes per square centimeter for each cloth are given in Table 2.

TABLE 2

| Cloth Sample Type | Porosity (# holes/cm$^2$) | Formula Spread Test Results: No Fiber Core (mm$^2$) | Formula Spread Test Results: With Fiber Core (mm$^2$) | Did a Formula Pool Form* on Surface? |
|---|---|---|---|---|
| 1. Nylon Netting | 64 | 0 | 0 | No |
| 2. Nylon Netting | 10 | 0 | 0 | No |
| 3. Nylon Netting | 154 | 0 | 0 | No |
| 4. Polyester Netting | 65 | 0 | 0 | No |
| 5. Polyester Netting | 61 | 0 | 0 | No |
| 6. Polyester Chiffon | 1470 | 176 | 40 | Yes |
| 7. Polyester Organza | 1314 | 215 | 64 | Yes |
| 8. Nylon Organza | 1480 | 50 | 10 | No |
| 9. Polyester Organza | 2509 | 450 | 96 | Yes |
| 10. Polyester Chiffon | 1640 | 30 | 25 | Yes |
| 11. Nonwoven Polyester | N/A | 1800 | 314 | No |
| 12. 60% Polyester-40% Rayon | 71 | 380 | 300 | No |
| 13. Cotton Broadcloth | 420 | 976 | 310 | No |
| 14. Cotton Muslin | 728 | 1452 | 615 | No |

(*)for at least 3 seconds.

In accordance with the acceptance criterion of the formula spread test described in this invention, any cloth which caused the spread of the applied formula to an area larger than 300 mm$^2$ (with or without a fiber mass backing) would be rejected for use as cover 14. Cloth samples numbered 9, 11, 12, 13, and 14 in Table 2 above would not be acceptable to be used as cover 14. Additionally, cloth samples numbered 6, 7, and 10 were not desirable because of their tendency to create a pool of formula that lasted for at least 3 seconds before the formula is absorbed into the mattress material. This left samples numbered 1 through 5, and 8 as acceptable candidates for use as cover 14. These samples of cloth had between 10 and 1480 holes per square centimeter corresponding to hole sizes ranging from 0.096 to 0.00026 cm$^2$. Any one of these sample cloths could have been selected for the infant mattress that was constructed according to this invention, cloth numbered 8 was used because of its higher strength and smoothness to touch.

An infant cradle mattress measuring 38 cm×76 cm×13 cm was constructed using a fiber mixture of 20% Celbond polyester fiber and 80% regular polyester fiber heat densified to a density of 0.0282 g/cm$^3$ as fiber core 12, and the 100% nylon cloth identified as number 8 in Table 1 as cover 14 which firmly encased fiber core 14 after the loose edges of cover 14 was sewn together with a sewing machine.

The infant mattress that was thus constructed was washed in warm light soapy water to remove the infant formula purposely spilled on it. The spilled formula easily washed off and the mattress dried completely when left standing in a tub overnight.

Thus, there is disclosed herein a firm, highly permeable, and washable infant mattress and a pad that is safer and more sanitary for infants. It will be seen that the objects set forth above, among those made apparent from the preceding description, are efficiently attained and, since certain changes may be made in the above construction without departing from the scope of the invention, it is intended that all matter contained in the above description or shown in the accompanying drawing figures shall be interpreted as illustrative only and not restrictive thereof.

I claim:

1. In the method of producing and using an infant mattress or pad, the steps that include a) providing said pad to have a liquid permeable fibrous core, and providing a high permeability cover to extend over and in contact with said pad, said cover provided to have a porous texture defined by strands of material, b) said strand texture provided to have sufficient open work as to freely pass aqueous liquid of a viscosity between 0.03 and 0.09 poise through said open work, and into said core, c) and maintaining the cover in contact with the core to wick liquid passing through the cover away from the covers, d) said porous strand texture being further provided to have through openings between the strands, said through openings provided to have an average size, over a substantial area of the cover on the pad, between 0.0002 and 0.1 cm$^2$, e) and including spilling said liquid onto said cover and allowing substantially all of said liquid to pass through said cover, within 3 seconds, said liquid consisting of infant formula.

2. The method of claim 1 wherein said liquid consists of infant formula defined as ready to feed, iron fortified SMA, a product of Wyeth Laboratories, Inc., Philadelphia, Pa.

3. The method of claim 1 including receiving said liquid onto said cover allowing substantially all of said liquid to pass through said cover onto said core, and wherein said liquid consists of infant formula defined as ready to feed, iron fortified SMA, a product of Wyeth Laboratories, Inc. Philadelphia, Pa.

4. The method of claim 1 wherein said porous texture is defined by woven strands consisting of one of the following:

i) yarn ii) filaments iii) knotted fabrics iv) braided fabrics v) sheet material having openings formed therethrough.

5. The method of claim 1 wherein said fibrous core consists of densified polyester fiber batting.

6. The method of claim 1 wherein said cover has permeability characterized by applying at one moment 2.5 ml of said liquid onto the cover at about 27° C., and observing that the liquid spreads to an area of less than 300 mm$^2$, said liquid having a viscosity of about 0.06 poise.

7. The method of claim 1 wherein said cover is provided in two halves, and including encasing said core in said two halves of the cover, and sewing said two halves together.

8. An infant supporting mattress or pad, comprising in combination:

a) a liquid permeable fibrous pad core, b) and a high permeability cover extending about the pad core, and in contact therewith, to wick liquid passing through the cover away from the cover, c) said cover including strands of material defining a cover porous texture, said texture characterized as freely passing aqueous liquid of a viscosity between 0.03 and 0.09 poise through said open work, and into said core, d) said cover defining through openings between the strands, said through openings having an average size over a substantial area of the cover on the pad, between 0.0002 and 0.1 $cm^2$, e) said cover texture further characterized as passing 2.5 ml liquid infant formula spilled on the cover, all the spilled liquid passing through the cover and into the core within 3 seconds, f) said porous texture defined by woven strands consisting of one of the following:

i) yard
ii) filaments
iii) knotted fabrics
iv) braided fabrics
v) sheet material having openings formed therethrough g) said cover consisting of NYLON having a porosity of about 1480 holes per square centimeter.

9. The combination of claim 8 wherein said fibrous core consists of densified polyester fiber batting.

10. The combination of claim 8 wherein said cover has permeability characterized by applying at one moment 2.5 ml of said liquid onto the cover at about 27° C., and observing that the liquid spreads to an area of less than 300 $mm^2$, said liquid having a viscosity of about 0.06 poise.

11. The combination of claim 8 wherein said cover comprises two halves encasing said core, and stiching interconnecting said two halves.

* * * * *

UNITED STATES PATENT AND TRADEMARK OFFICE

CERTIFICATE OF CORRECTION

PATENT NO. : 5,826,288

DATED : Oct. 27,1998

INVENTOR(S) : Gunes M. Ecer

It is certified that error appears in the above-indentified patent and that said Letters Patent is hereby corrected as shown below: On the title page, and col. 1:

Item: [54] "HIGHLY PREMEABLE INFANT MATTRESS AND PAD" should read --HIGHLY PERMEABLE INFANT MATTRESS AND PAD--

Signed and Sealed this

Twentieth Day of April, 1999

*Attest:*

Q. TODD DICKINSON

*Attesting Officer*

*Acting Commissioner of Patents and Trademarks*